US010016764B2

(12) United States Patent
Ivanoff

(10) Patent No.: US 10,016,764 B2
(45) Date of Patent: Jul. 10, 2018

(54) APPARATUS FOR PROCESSING AGGREGATE MATERIAL

(71) Applicant: CDE Global Limited, Cookstown, County Tyrone (GB)

(72) Inventor: Enda Ivanoff, Moy (GB)

(73) Assignee: CDE Global Limited, Cookstown, County Tyrone (GB)

( * ) Notice: Subject to any disclaimer, the term of this patent is extended or adjusted under 35 U.S.C. 154(b) by 0 days.

(21) Appl. No.: 15/468,425

(22) Filed: Mar. 24, 2017

(65) Prior Publication Data

US 2017/0282190 A1 Oct. 5, 2017

(30) Foreign Application Priority Data

Mar. 30, 2016 (GB) ..... 1605363.9

(51) Int. Cl.
*B03B 5/40* (2006.01)
*B03B 9/00* (2006.01)
(Continued)

(52) U.S. Cl.
CPC ..... *B03B 9/00* (2013.01); *B03B 5/40* (2013.01); *B07B 1/28* (2013.01); *B02C 18/142* (2013.01); *B07B 2201/04* (2013.01)

(58) Field of Classification Search
CPC .... B03B 5/40; B03B 5/52; B03B 5/62; B03B 9/00; B03B 11/00; B03B 2011/008;
(Continued)

(56) References Cited

U.S. PATENT DOCUMENTS 15,827 A * 9/1856 Thomas ..... B03B 5/52 209/464
1,609,652 A * 12/1926 McQueen ..... B03B 5/02 209/464
(Continued)

FOREIGN PATENT DOCUMENTS

CN 203725248 7/2014
EP 0228724 7/1987
(Continued)

OTHER PUBLICATIONS

European Search Report for corresponding European Application No. EP17162539, dated Jul. 20, 2017.
(Continued)

*Primary Examiner* — Joseph C Rodriguez
(74) *Attorney, Agent, or Firm* — Gardner, Linn, Burkhart & Ondersma LLP

(57) ABSTRACT

An apparatus for processing aggregate material comprising an inclined trough having a pair of shafts rotatably mounted therein, the shafts having staggered blades arranged pass between one another during rotation of the shafts and angled to carry material towards an upper end of the trough, excess water and any floating trash passing over a weir adjacent a lower end of the trough onto the deck of a first vibratory screen, and a second vibatory screen being mounted adjacent the upper end of the trough for receiving particulate material from the upper end of the trough, the second vibratory screen having at least one deck for grading the material, wherein water collected in a sump of the first vibratory screen is arranged to pass into a sump of the second vibratory screen.

15 Claims, 7 Drawing Sheets

(51) Int. Cl.
*B07B 1/28* (2006.01)
*B02C 18/14* (2006.01)

(58) Field of Classification Search
CPC ..... B07B 1/28; B07B 2230/01; B02C 13/20; B02C 18/142; B02C 23/10; B02C 23/14; B02C 23/16
See application file for complete search history.

(56) References Cited

U.S. PATENT DOCUMENTS 1,695,021 A * 12/1928 Puryear ..... B03B 5/52 209/18
2,025,841 A * 12/1935 Young ..... B03B 5/623 209/156
2,378,356 A * 6/1945 Erck ..... B03B 5/52 209/17
3,807,558 A 4/1974 Hamm
4,272,363 A * 6/1981 Cargile, Jr. ..... B03B 5/52 209/10
5,896,997 A * 4/1999 Tanner ..... B03B 5/26 209/268
RE38,367 E * 12/2003 Southall ..... B03B 9/00 175/206
7,514,011 B2 * 4/2009 Kulbeth ..... B01D 21/0045 175/206
7,690,513 B1 4/2010 Gustin
7,954,642 B2 * 6/2011 Jody ..... B03B 5/623 209/158
8,151,993 B2 * 4/2012 Smith ..... B03B 11/00 209/162
9,327,291 B2 * 5/2016 Brodt ..... B03B 7/00
9,486,811 B2 * 11/2016 Weber ..... B03B 5/00
2003/0155278 A1 8/2003 Mirras
2017/0361332 A1 * 12/2017 Bennington ..... B03B 5/02

FOREIGN PATENT DOCUMENTS

GB 2523657 9/2015
GB 2523658 9/2015

OTHER PUBLICATIONS

UK Examination Report for corresponding UK Application No. GB1605363.9, dated Nov. 24, 2016.

* cited by examiner

APPARATUS FOR PROCESSING AGGREGATE MATERIAL

FIELD OF THE INVENTION

This invention relates to an apparatus for processing aggregate material and, in particular, to an apparatus for removing light contaminants such as trash from aggregate material.

BACKGROUND OF THE INVENTION

In the production of aggregate materials, such as sand, gravel, crushed rock, scalpings and iron and other mineral ores, the desired product material will often be contaminated with clay or other soils, organic material such as grass, roots, and small wood or tree branch fragments, and man-made waste materials, such as light plastics. In order to prepare such aggregate product material for market, it is necessary to process the product material so that it is free from such contaminants.

For heavily contaminated aggregate materials this is often achieved in what is known as a "logwasher". A logwasher typically comprises a trough mounted at an inclined angle relative to horizontal to which water is added, the feed material being delivered into a lower end of the trough. A pair of parallel shafts or logs are rotatably mounted within the trough and are driven to rotate in opposite directions. Each shaft has a plurality of paddles or blades mounted thereon, usually mounted to the shaft at an angle, the paddles on adjacent shafts being staggered so that mud balls and other clumps of material are broken down by attrition of the material between the blades of the adjacent shafts. The blades are angled so that they carry the product material towards the raised end of the trough, where the separated and washed product material is discharged, typically onto a grading and/or dewatering screen.

Contaminants separated from the product material, typically comprising grass, roots, twigs and light plastics, (known as trash) typically float on top of the water in the trough. It is known to provide a weir in the lower end wall of the trough, such weir defining the maximum water level within the trough, while excess water and floating trash may pass over the weir to exit the trough.

It is necessary to dewater such trash before it can be collected and disposed of. Therefore is known to provide a dewatering screen beneath the trough onto which the trash can be collected and dewatered after leaving the trough entrained in a flow of water via the weir. However, the arrangement of such dewatering screen beneath the lower end of the trough of the log washer increases the overall height of the apparatus and requires additional conveying arrangements for conveying the dewatered trash from the deck of the dewatering screen onto a suitable stockpile. Fine material and water may be collected in a sump of the dewatering screen for further processing and/or disposal.

SUMMARY OF THE INVENTION

An apparatus for processing aggregate material comprising a chassis, a trough mounted on the chassis at an inclined angle, a pair of parallel shafts being rotatably mounted within the trough adjacent one another to extend from a lower to an upper end of the trough, a drive being adapted to driving the shafts in opposite directions, each shaft having a plurality of blades mounted thereon, the blades on the shafts being staggered such that the blades on the adjacent shafts can pass between one another during rotation of the shafts, and wherein the blades are angled so that they carry material within the trough towards an upper end of the trough when the shafts are rotated by the drive in a normal direction of rotation, a water supply provided for adding water to the trough, wherein at least one weir is provided in a side wall of the trough adjacent a lower end thereof over which excess water and any floating trash within the trough may pass, the at least one weir defining a normal water level within the trough during operation of the apparatus, a first vibratory screen being mounted adjacent the lower end of the trough such that water and floating trash overflowing from the weir passes onto a deck of the first vibratory screen, dewatered trash passing over a downstream end of the deck of the first vibratory screen while undersize material and water passes into a sump of the first vibratory screen, a second vibratory screen being mounted adjacent the upper end of the trough for receiving particulate material from the upper end of the trough, the second vibratory screen having at least one deck over which oversize material passes and a sump into which water and undersize material passing through the at least one deck of the second vibratory screen is collected, wherein water collected in the sump of the first vibratory screen is arranged to pass into the sump of the second vibratory screen.

In one embodiment the first vibratory screen may be mounted on the trough. In an alternative embodiment the first vibratory screen may be mounted on the chassis below the lower end of the trough The deck of the first vibratory screen may extend transverse to the axis of the trough.

Optionally, a pair of weirs are provided on opposite sides of the trough, each weir being arranged to deliver water and floating material from the trough onto the deck of the first vibratory screen. The deck of the first vibratory screen may be divided into two sections, a first section receiving water and trash from a first weir of the trough on a first side thereof and a second section receiving water and trash from a second weir of the trough on a second side thereof. The first and second sections of the deck of the first vibratory screen may be arranged to convey material in opposite directions. In one embodiment the the first and second sections of the deck of the first vibratory screen may be arranged to convey material towards a central discharge region located between the first and second sections of the deck.

The height of the at least one weir may be adjustable to adjust the depth of water within the lower end of the trough.

Optionally, a pipe or other conduit extends between the sump of the first vibratory screen and the sump of the second vibratory screen. Optionally, the pipe extends on a downwardly inclined angle between the sump of the first vibratory screen and the sump of the second vibratory screen.

The second vibratory screen may be mounted on the chassis below the upper end of the trough.

The second vibratory screen may comprise a multiple deck screen adapted to provide multiple grades of aggregate product therefrom in terms of particle size. For example, the second vibratory screen may comprise at least two decks arranged one above the other, and generally parallel to each other, each with a downward slope from an upper receiving end to a lower discharge end at which over-sized material relative to apertures formed in the respective deck can be discharged under gravity from the discharge end of the respective deck onto a respective stockpile conveyor, whereas under-sized material able to pass downwardly through the screening apertures of the respective screen deck falls under gravity onto the deck below, where the further screening action takes place, or into the collection sump in the case of the lowest deck.

These and other objects, advantages and features of the invention will become apparent upon review of the following specification in conjunction with the drawings.

BRIEF DESCRIPTION OF THE DRAWINGS

An apparatus for processing aggregate material in accordance with an embodiment of the present invention will now be described, by way of example only, with reference to the accompanying drawings, in which.

DESCRIPTION OF THE PREFERRED EMBODIMENTS

Figure 1:
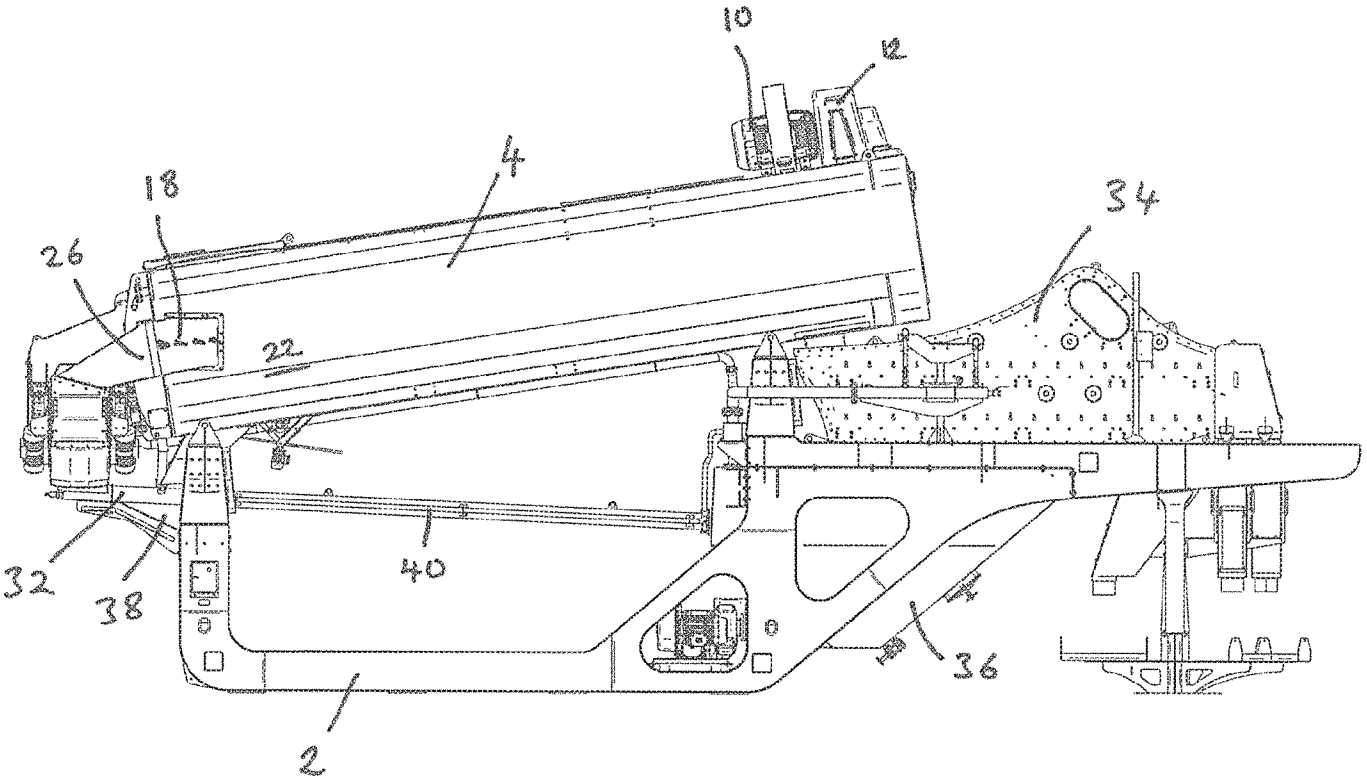
FIG. 1 is a side view of an aggregate processing apparatus in accordance with an embodiment of the present invention.

An apparatus for processing aggregate material in accordance with an embodiment of the present invention, as illustrated in FIGS. 1 to 5, comprises a chassis 2 upon which is mounted a logwasher comprising a trough 4 mounted on the chassis at an inclined angle, a pair of parallel shafts 6, 8 rotatably mounted within the trough 4 extending from a lower to an upper end of the trough 4 adjacent one an other, an electric motor 10 being provided for driving the shafts in opposite directions via a gearbox or drive belt/chain 12, each shaft 6, 8 having a plurality of blades 14, 16 mounted thereon. The blades 14, 16 on the adjacent shafts 6, 8 are staggered such that the blades 14, 16 on the adjacent shafts 6, 8 can pass between one another during rotation of the shafts 6, 8. The blades 14, 16 are angled so that they carry material within the trough towards an upper end of the trough when the shafts 6, 8 are rotated by the motor 10 in a normal direction of rotation while scrubbing the material to separate and break up contamination stuck to the material.

Spray bars (not shown) are provided for adding water to the trough and a pair of weirs 18, 20 are provided in opposite side walls 22, 24 on either side of the trough 4 at a lower end of the trough 4 over which weirs 18, 20 excess water and any trash floating thereon can pass. The height of the weirs 18, 20 determines and delimits the water level within the lower end of the trough 4, defining a normal operating water level within the trough when the apparatus is in use. The height of the upper edge of each weir 18, 20 may be adjustable to allow adjustment of the water level within the trough 4. It is envisaged that one or more weirs may additionally or alternatively be provided in the rear wall of the lower end of the trough.

Each weir 18, 20 leads to a respective duct 26, 28 on the sides of the trough 4, the ducts 26, 28 extending downwardly and rearwardly from the sides of the trough 4 to convey water and trash onto the deck 30 of a dewatering screen 32 mounted adjacent the lower end of the trough 4, whereupon the collected trash is dewatered via a vibratory motion of the deck imparted thereto by a suitable vibration generating device, before being passed onto a conveyor or into a suitable collection receptacle for stockpiling and disposal. The dewatering screen 32 may be mounted directly on the trough 4 or may be mounted on the chassis 2 adjacent the lower end of the trough 4. In one embodiment the dewatering screen 32 is mounted directly upon the lower end of the trough 4 to effectively hang from the trough 4. This provides a particularly compact arrangement.

The trough 4 may be adjustably mounted on the chassis 2 to enable adjustment of the angle of inclination of the trough 4. The angle of trough may be increased or decreased for different retention times. Where the dewatering screen 32 is mounted on the trough, the mounting of the dewatering screen 32 may be adjustable in order to ensure that the deck of the dewatering screen remains level.

At least a portion of each duct 26, 28 leading from the respective weirs 18, 20 may be formed from a resilient or flexible material to permit relative movement between the dewatering screen 32 and the trough 4.

Figure 2:
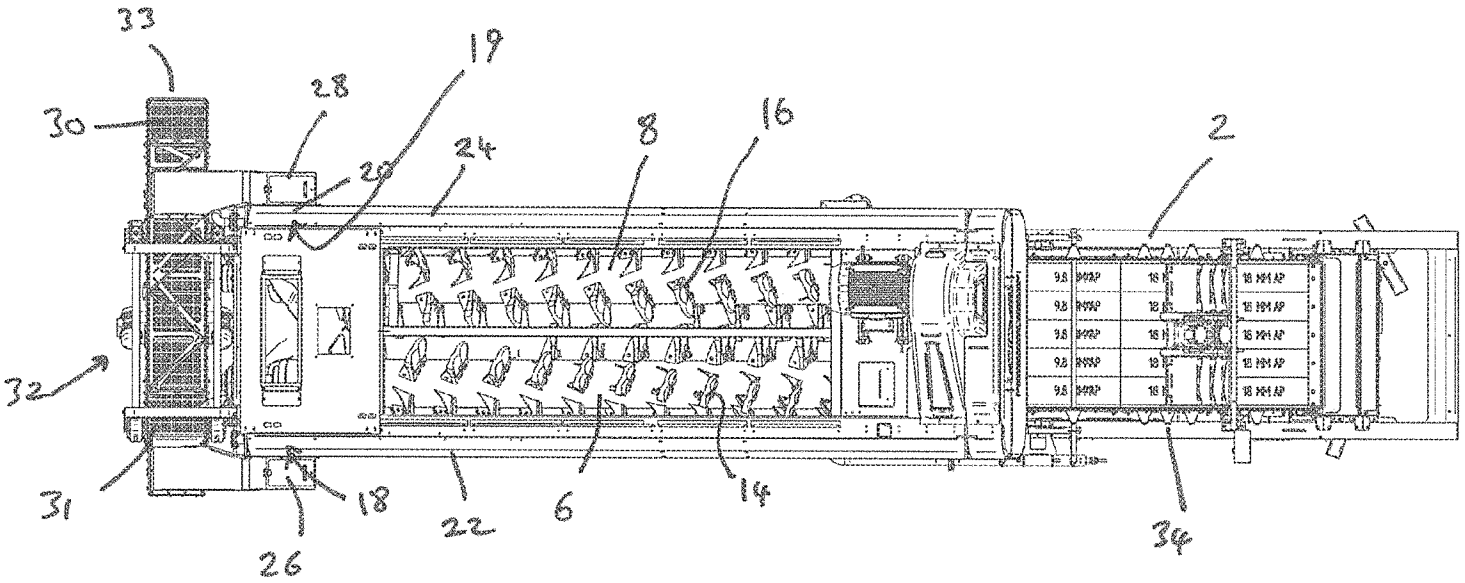
FIG. 2 is a plan view of the apparatus of FIG. 1.
Figure 3:
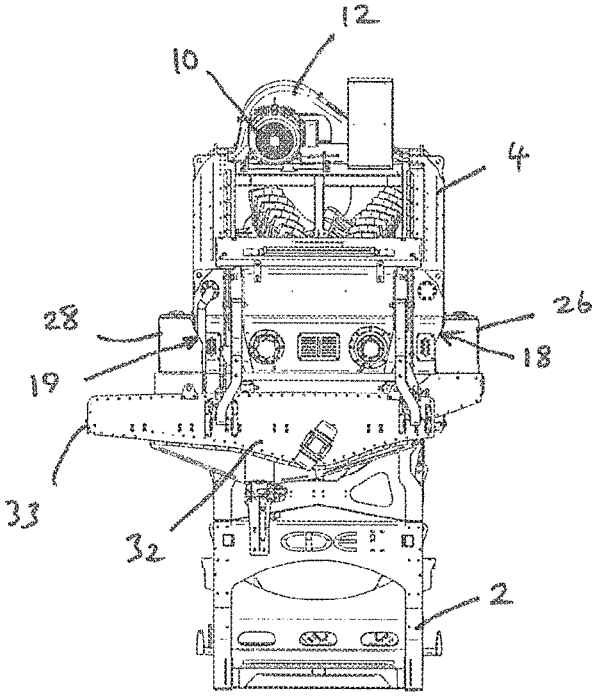
FIG. 3 is an end view of the apparatus of FIG. 1.
Figure 4:
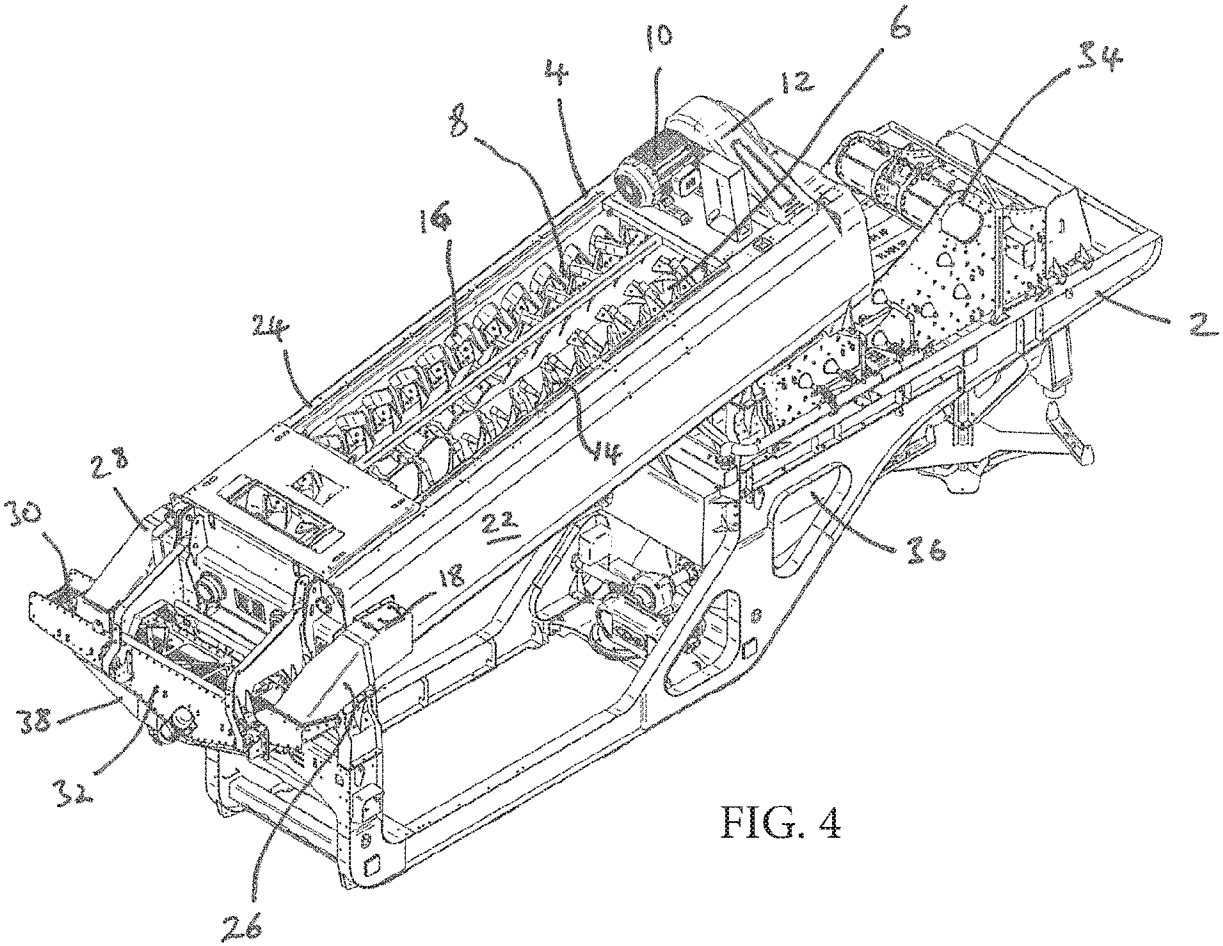
FIGS. 4 and 5 are perspective views of the apparatus of FIG. 1.

The deck 30 of the dewatering screen 32 is arranged below the weirs 18, 20 such that water and trash is conveyed onto the deck 30 via the ducts 26, 28 under the action of gravity. As best seen in FIG. 2, a first duct 26 delivers water and trash downwardly and rearwardly from a first weir 18 in a first side of the trough 4 onto an upstream end 31 of the deck 30 of the dewatering screen 32 while a second duct 28 delivers water and trash downwardly and rearwardly onto the deck 30 of the dewatering screen 32 between the upstream end of the deck 30 and a discharge end 33 of the deck 30, the discharge end 33 of the deck 30 extending to one side of the chassis 2 of the apparatus.

A grading screen 34 is mounted on the opposite end of the chassis from the dewatering screen 32, the grading screen being arranged to receive washed aggregate material from an upper end of the trough 4.

Optionally, the grading screen 34 comprises a multiple deck screen adapted to provide multiple grades of aggregate product therefrom in terms of particle size. For example, two or three decks may be arranged one above the other, and generally parallel to each other, each with a downward slope from an upper receiving end to a lower discharge end at which over-sized material (relative to the apertures in the screen deck concerned) can be discharged. Material of a size in excess of the size of the screening apertures of each screen deck is discharged under gravity from the lower or downstream end of the respective deck onto a respective stockpile conveyor, whereas under-sized material able to pass downwardly through the screening apertures of the respective screen deck falls under gravity onto the deck below, where the further screening action takes place, or into a collection sump 36 in the case of the lowest deck. A triple deck screen assembly can grade feed material into four or more separate grades (particle size) of product. An example of such triple deck screen arrangement is shown in GB 2523658, incorporated herein by reference. It is envisaged that the grading screen may be replaced by a dewatering screen having a single deck for rinsing and dewatering the aggregate product from the logwasher where no further grading is required.

The dewatering screen 32 has a collection sump 38 beneath the deck 30 thereof. A transfer pipe or trough 40 extends from the collection sump 38 of the dewatering screen 32 to the sump 36 of the grading screen 34 for transferring water from the collection sump 38 of the grading screen 34 into the sump 36 of the grading screen 34. The collection sump 38 of the dewatering screen 34 is located at a higher level than the sump 36 of the grading screen so that the transfer pipe or trough 40 is inclined downwardly from the collection sump 38 of the dewatering screen 32 to the sump 36 of the grading screen 34, allowing water to transfer between the sumps 38, 36 under the action of gravity.

In use, a feed material, comprising an aggregate material having a range of particle size mixed with clay or other soils and contaminated with organic material, such as grass, roots, and small wood or tree branch fragments, and man-made waste materials, such as light plastics, is fed into the lower end of the trough, to which water has been added, and the shafts 6, 8 are rotated such that the blades 14, 16 cause attrition of the material, breaking up the clay and soil bound to the aggregate material, causing intense scrubbing to separate the aggregate material from any contamination. The angle of the blades causes the aggregate material to be conveyed up the trough towards and outlet opening at an upper end of the trough 4, from which opening the cleaned aggregate material falls onto an upper deck of the grading screen 34. During such process further water is added to the trough 4 via the spray bars and excess water passes over the weirs 18, 20, defining the maximum water level in the trough, such excess water being delivered onto the deck 30 of the dewatering screen 32, along with the light organic material and plastics, collectively referred to as trash, which tends to float on surface of the water within the trough 4.

The trash is dewatered on the deck 30 of the dewatering screen 34 before passing over the discharge end 33 of the deck 30, and then may pass onto a suitable stockpiling conveyor or into a suitable receptacle. At the same time the water passes through the apertures in the deck 30 of the dewatering screen into the collection sump 38 thereof before passing through the transfer pipe 40 and into the sump 36 of the grading screen 34.

Figure 5:
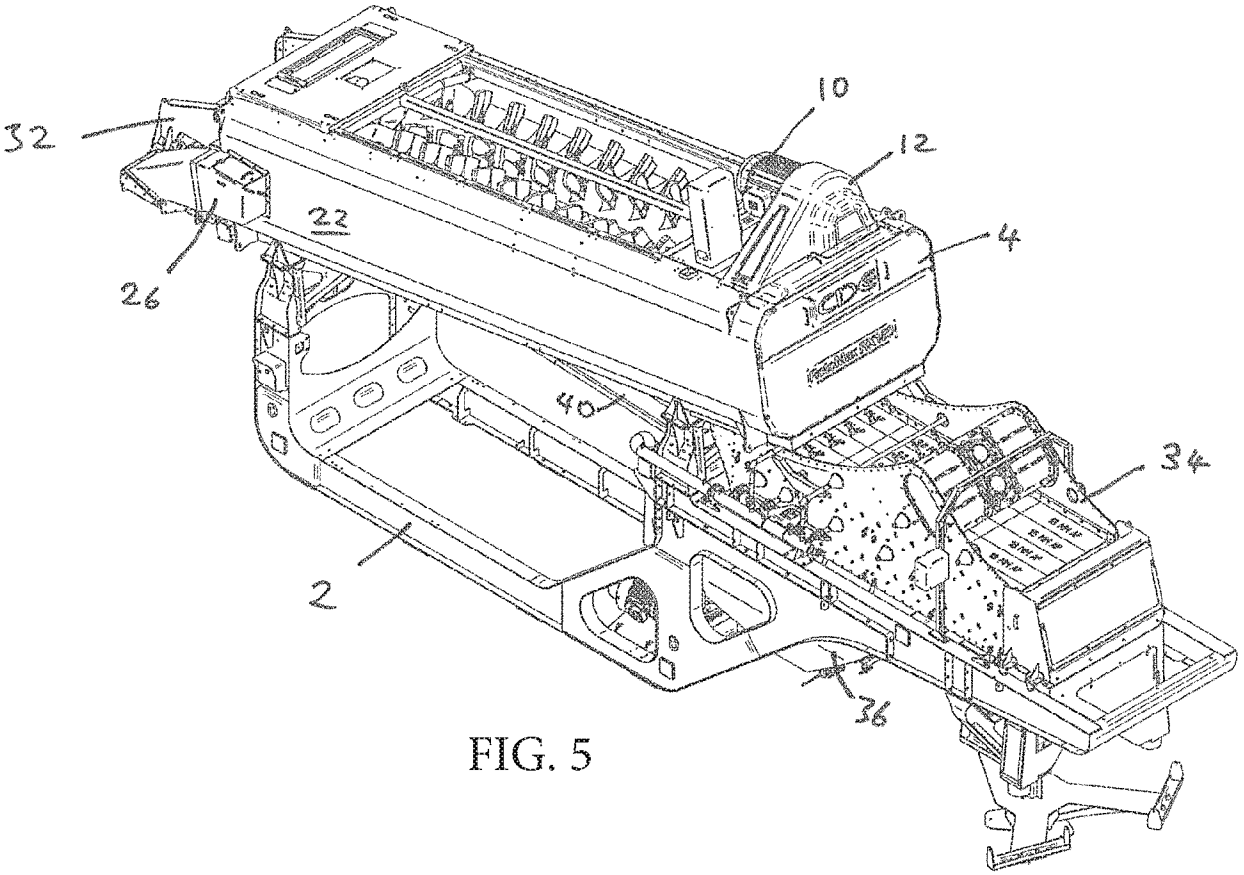
Figure 6:
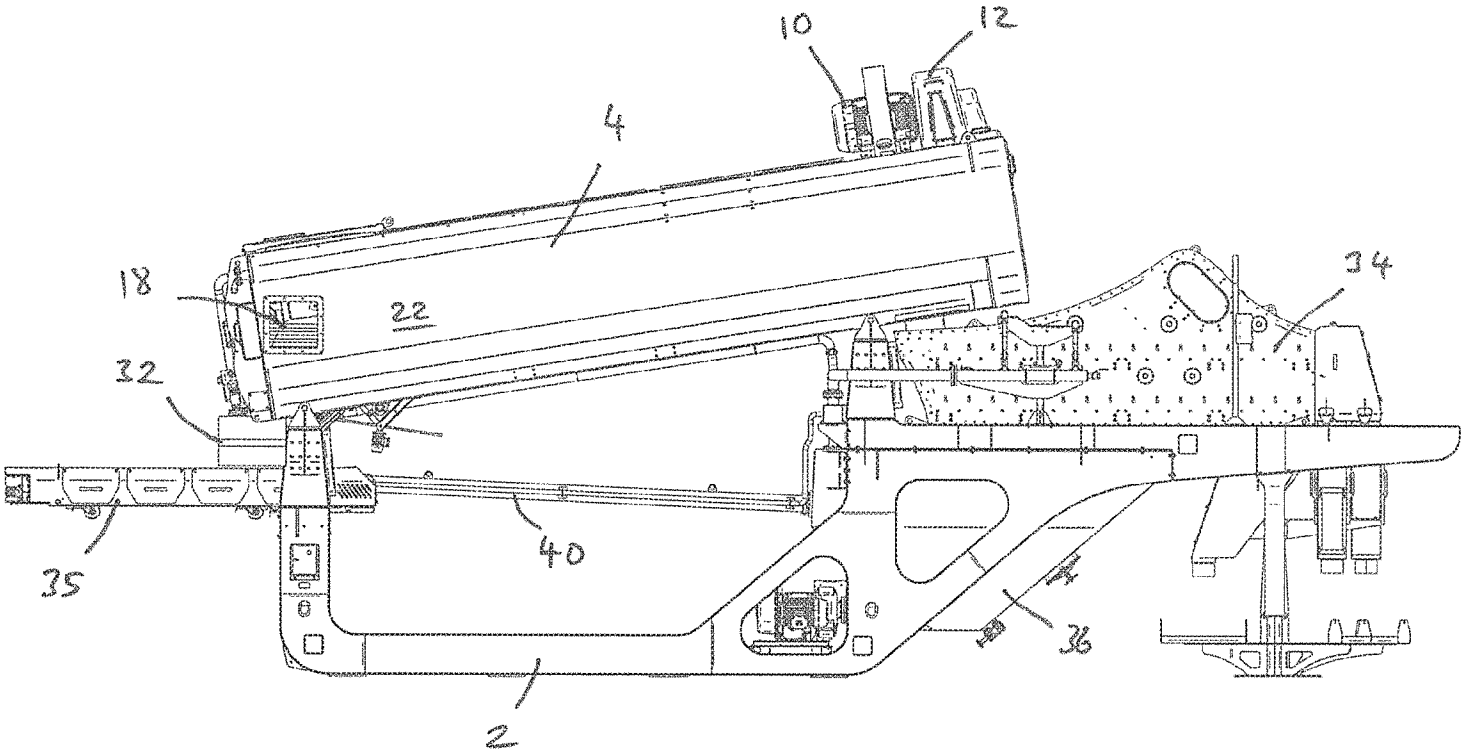
FIG. 6 is a side view of a modified embodiment of the present invention.
Figure 7:
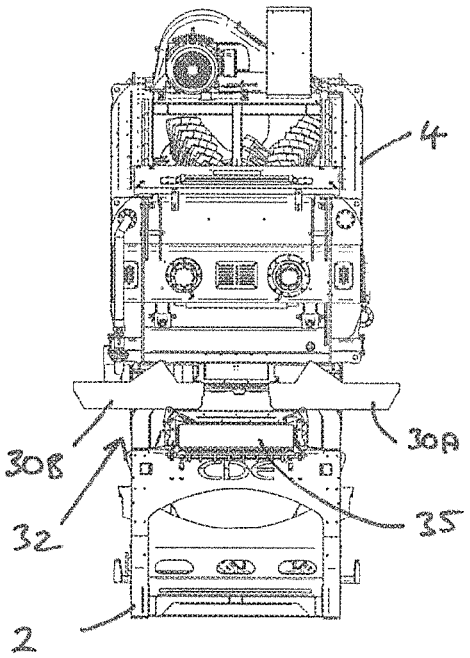
FIG. 7 is an end view of the apparatus of FIG. 6.

In an alternative embodiment, shown in FIGS. 5 and 6, the deck of the dewatering screen 32 may be divided into two section 30A, 30B, a first section 30A receiving water and trash from the first weir 18 of the trough 4 via the first duct 26 on a first side thereof and a second section 30B receiving water and trash from the second weir 20 of the trough 4 via the second duct 28 on a second side thereof. The first and second sections 30A, 30B of the deck of the dewatering screen 32 are arranged to convey material towards a central discharge region 33 located between the first and second sections of the deck and onto a central conveyor 35 extending rearwardly from the chassis 2 of the apparatus.

A further grading screen may be provided above the lower/feed end of trough of the logwasher for feeding material into the trough. Material may be fed onto such further grading screen first, the oversize aggregate material passing into the trough and the remaining undersize material, for example sand, being transferred to a further process for processing. A different type of screen may be mounted above logwasher to remove large rocks that are too big for logwasher and would damage it. In this case, such oversize large materials would pass over such screen to be discarded or collected while smaller rocks would pass through the deck of the screen into the trough of the logwasher. These screens could be mounted on chassis or directly on the trough.

The invention is not limited to the embodiment(s) described herein, but can be amended or modified without departing from the scope of the present invention, which is intended to be limited only by the scope of the appended claims as interpreted according to the principles of patent law including the doctrine of equivalents.

The invention claimed is:

1. An apparatus for processing aggregate material, the apparatus comprising:

a chassis;

a trough mounted on the chassis at an inclined angle;

a pair of parallel shafts being rotatably mounted within the trough adjacent one another and extending from a lower end of the trough to an upper end of the trough, each shaft having a plurality of blades mounted thereon, the blades on the shafts being staggered such that the blades on the adjacent shafts can pass between one another during rotation of the shafts, and wherein the blades are angled so that they carry material within the trough towards an upper end of the trough when the shafts are rotated in a normal direction of rotation;

a drive adapted to drive the shafts in opposite directions, a water supply for adding water to the trough;

at least one weir is provided in a side wall of the trough adjacent a lower end thereof, over which excess water and any floating material within the trough may pass, the at least one weir defining a normal water level within the trough during operation of the apparatus;

a first vibratory screen being mounted adjacent the lower end of the trough such that water and floating material overflowing from the weir passes onto a deck of the first vibratory screen, whereby dewatered trash passes over a downstream end of the deck of the first dewatering screen while undersize material and water passes into a sump of the first dewatering screen; and a second vibratory screen being mounted adjacent the upper end of the trough for receiving particulate material from the upper end of the trough, the second vibratory screen having at least one deck over which oversize material passes and a sump into which water and undersize material passing through the at least one deck of the second vibratory screen is collected, wherein the first and second vibratory screens are arranged so that water collected in the sump of the first vibratory screen passes into the sump of the second vibratory screen.

2. The apparatus of claim 1, wherein the first vibratory screen is mounted on the trough.

3. The apparatus of claim 1, wherein the first vibratory screen is mounted on the chassis below the lower end of the trough.

4. The apparatus of claim 1, wherein the deck of the first vibratory screen extends transverse to a longitudinal axis of the trough.

5. The apparatus of claim 1, wherein a pair of weirs are provided on opposite sides of the trough, each weir being arranged to deliver water and floating material from the trough onto the deck of the first dewatering screen.

6. The apparatus of claim 5, wherein the deck of the first vibratory screen is divided into two sections, a first section receiving water and floating material from a first weir of the trough on a first side thereof and a second section receiving water and floating material from a second weir of the trough on a second side thereof.

7. The apparatus of claim 6, wherein the first and second sections of the deck of the first vibratory screen are arranged to convey material in opposite directions.

8. The apparatus of claim 7, wherein the first and second sections of the deck of the first vibratory screen are isolated from one another and are arranged to convey material towards a central discharge region located between the first and second sections of the deck.

9. The apparatus of claim 1, wherein the height of the at least one weir is adjustable to adjust the depth of water within the lower end of the trough.

10. The apparatus of claim 1, wherein a pipe, trough or other conduit extends between the sump of the first vibratory screen and the sump of the second vibratory screen.

11. The apparatus of claim 10, wherein the pipe, trough or other conduit extends an a downwardly inclined angle between the sump of the first vibratory screen and the sump of the second vibratory screen.

12. The apparatus of claim 1, wherein the second vibratory screen is mounted on the chassis below the upper end of the trough.

13. The apparatus of claim 1, wherein the second vibratory screen comprises a multiple deck screen adapted to provide multiple grades of aggregate product therefrom according to particle size.

14. The apparatus of claim 13, wherein the second vibratory screen comprises a grading screen having at least two decks arranged one above the other, and generally parallel to each other, each of the at least two decks having a downward slope from a respective upper receiving end to a respective lower discharge end at which over-sized material relative to apertures formed in the respective deck can be discharged under gravity from the discharge end of the respective deck onto a respective stockpile conveyor, whereas under-sized material able to pass downwardly through the screening apertures of the respective screen deck falls under gravity onto the deck below, where the further screening action takes place, or into the collection sump in the case of the lowest deck.

15. An apparatus for processing aggregate material, said apparatus comprising:

an inclined trough;

a pair of shafts rotatably mounted in the trough, the shafts having staggered blades arranged to pass between one another during rotation of the shafts, the blades being angled to carry material towards an upper end of the trough during rotation of the shafts;

a first vibratory screen having a first deck and a first sump for collecting water;

a weir adjacent a lower end of the trough, wherein excess water and any floating material passing over the weir passes onto the deck of the first vibratory screen; and a second vibratory screen mounted adjacent the upper end of the trough for receiving particulate material from the upper end of the trough, the second vibratory screen having a second deck for grading the material, wherein the first and second vibratory screens are arranged so that water collected in the first sump passes into a second sump of the second vibratory screen.

* * * * *